US006175337B1

(12) United States Patent
Jasper, Jr. et al.

(10) Patent No.: US 6,175,337 B1
(45) Date of Patent: Jan. 16, 2001

(54) HIGH-GAIN, DIELECTRIC LOADED, SLOTTED WAVEGUIDE ANTENNA

(75) Inventors: Louis J. Jasper, Jr., Fulton, MD (US); Joseph R. Miletta, Fairfax Station; George Merkel, Springfield, both of VA (US)

(73) Assignee: The United States of America as represented by the Secretary of the Army, Washington, DC (US)

( * ) Notice: Under 35 U.S.C. 154(b), the term of this patent shall be extended for 0 days.

(21) Appl. No.: 09/398,954

(22) Filed: Sep. 17, 1999

(51) Int. Cl.[7] ..... H01Q 13/10
(52) U.S. Cl. ..... 343/770; 343/771
(58) Field of Search ..... 343/770, 767, 343/753, 771, 700 MS, 846, 754

(56) References Cited

U.S. PATENT DOCUMENTS 5,717,410 * 2/1998 Ohmine et al. ..... 343/771
5,757,329 * 5/1998 Hoover et al. ..... 343/770
5,844,523 * 12/1998 Brennan et al. ..... 343/700 MS
6,037,908 * 3/2000 Phillips et al. ..... 343/753

* cited by examiner

*Primary Examiner*—Don Wong
*Assistant Examiner*—Chuc D Tran
(74) *Attorney, Agent, or Firm*—Paul S. Clohan, Jr.

(57) ABSTRACT

A high-gain, dielectric loaded, slotted waveguide antenna having a photonic bandgap, a high-impedance electromagnetic structure, in contact with the waveguide surface containing longitudinal slots, and a tailored dielectric material structure in contact with the outer surface of the photonic bandgap structure. The tailored dielectric structure at the inner most surface has the same effective dielectric constant of the waveguide material and the photonic bandgap structure. The effective dielectric constant is then incrementally or continuously reduced to have a dielectric constant close to that of the free-space value at the outer surface further distance from the waveguide array. The tailoring of the effective dielectric constant is achieved by layering a given number of slabs of different dielectric constants with sequentially reduced values, or by varying the chemical composition of the material, or by varying the density of the material imbedded with high dielectric constant particles.

8 Claims, 7 Drawing Sheets

$$Z = \frac{j\omega L}{1-\omega^2 LC}$$

HIGH-GAIN, DIELECTRIC LOADED, SLOTTED WAVEGUIDE ANTENNA

RIGHTS OF THE GOVERNMENT

The invention described herein may be manufactured, used, and licensed by or for the United States Government for governmental purposes without the payment to us of any royalty thereon.

BACKGROUND OF THE INVENTION

1. Field of the Invention

This invention relates to military antennas for applications where high-gain, high-peak and -average microwave power, compactness, and ruggedness are requirements for Directed Energy Weapons (DEWs) and radars.

2. Discussion of Related Art

In-order-to meet the radiated power and tunable waveform requirements for DEWs and radars, high-gain, high-peak and -average microwave power antennas are needed. The antennas must be compact and rugged to give reduced electromagnetic (EM) and visual signatures and to survive under various battlefield conditions such as high-wind, extreme temperatures, vibrations, etc. The antennas need high-gain characteristics above 30 $dB_i$ to make the prime power system, power conditioning and power managing systems, HPM source, ancillary equipment, and the overall integrated system highly efficient, low-cost, and compatible with mobility and maneuverability requirements for light forces. Practical applications of EM directed energy systems on the tactical battlefield demand the highest achievable antenna gains for the minimum antenna physical cross-section. These attributes are at obvious conflict. The desired size of the antenna is governed by the sizes of the available prime movers and their road and transport-ability. It is desired that any DEW antenna be no larger than the size of a standard tactical shelter. The antenna should have a gain of 30 $dB_i$ or better with a main lobe beam width of on the order of a few degrees. It should represent a major improvement over present parabolic dish and horn designs.

SUMMARY OF THE INVENTION

Accordingly, it is an object of the present invention to fulfill the urgent military need for compact, high-gain/high-power antennas that are rugged for the battlefield environments and are compatible for mobile, tactical platforms with DEWs and radars.

Briefly, the foregoing and other objects are achieved by using a resonant array of four dielectric loaded waveguide modules containing longitudinal slots. The dielectric material inside the waveguide is chosen to have a low-loss tangent, high-voltage breakdown potential, and a dielectric constant to give a waveguide wavelength that is reduced by at least a factor of 2 (preferably 3 or 4) over that of the corresponding free-space wavelength. The four-module structure is selected where the feed structure distributes power equally to the four modules. On the outside surface of the four-module array, in contact with the surface containing the longitudinal slots, is a dielectric material structure. It is tailored to have the same dielectric constant of the waveguide material at the inner most surface, and then incrementally or continuously reduced to have a dielectric constant close to that of the free-space value at the outer surface further distance from the waveguide array.

In another embodiment, on the outside surface of the four-module array, in contact with the waveguide surface containing the longitudinal slots is a Photonic Bandgap (PBG), high-impedance EM structure with a band gap corresponding to the designed bandwidth and frequency of operation for the antenna. The PBG structure has an effective dielectric constant equal to the dielectric constant of the material inside the waveguide. It has a high-impedance EM surface. It has channel defects that are equal in number to the waveguide slots, perfectly aligned with the slots, and it has a geometrically equivalent cross-sectional area equal to that of the four-module array. The channels serve as radiating paths in the PBG structure. The PBG structure eliminates propagating surface waves, gives image currents that are in phase, and confines the radiation to the channels.

In the preferred embodiment, the invention places the PBG, high-impedance EM structure in contact with the waveguide surface containing the longitudinal slots, and places the tailored dielectric material structure in contact with the PBG structure. The tailored dielectric structure at the inner most surface has the same effective dielectric constant of the waveguide material and the PBG structure. The effective dielectric constant is then incrementally or continuously reduced to have a dielectric constant close to that of the free-space value at the outer surface further distance from the waveguide array. The tailoring of the effective dielectric constant is achieved by layering a given number of slabs of different dielectric constants with sequentially reduced values. Also, one can achieve tailoring of the effective dielectric constant by varying the chemical composition of the material, or by varying the density of a very high dielectric material imbedded in a very low dielectric material.

BRIEF DESCRIPTION OF THE DRAWINGS

The invention will be better understood, and further objects, features, and advantages thereof will become more apparent from the following description of the preferred embodiment, taken in conjunction with the accompanying drawings in which.

DETAILED DESCRIPTION OF THE PREFERRED EMBODIMENT

The High-Gain, Dielectric Loaded, Slotted Waveguide Antenna receives HPM energy from a microwave generator such as a microwave tube. Waveguide having air as the interior medium transports the microwave energy from the tube to a corporate antenna feed network. The physical arrangements of the feed sections are chosen for flexibility in configuring the source interface. The transition from air medium to dielectric medium inside the waveguide is chosen to be done at the waveguide section preceding the corporate antenna feed network. The impedance match necessary to accomplish the transition with minimal VSWR and maximum power transfer is designed using equations for impedance matching in waveguides found in antenna engineering and electrical engineering handbooks. Therefore, the corporate feed network waveguide and the antenna elements (waveguides) are dielectrically loaded to achieve compactness. For a frequency of 1.3 GHz and a dielectric constant $\epsilon_r$ of 9, the waveguide wavelength is 7.9 cm, which is about 4 times smaller than the air-filled waveguide. The dielectrically loaded waveguide wavelength $\lambda_g$ is proportional to $1/(\epsilon_r)^{1/2}$ where the relative permeability $\mu_r$=1. This reduces the cross-sectional area of the antenna with air-filled waveguide elements from about 14 $m^2$ to about 0.6 $m^2$ for the dielectric loaded waveguide element antenna. For an antenna that operates below about 1 GHz, a material(s) that has both an $\epsilon_r$ and $\mu_r$ greater than 1 is beneficial for tailoring the waveguide wavelength and impedance since $\lambda_g \alpha 1/(\epsilon_r \mu_r)^{1/2}$ and the impedance K $\alpha$ $(\mu_r/\epsilon_r)^{1/2}$. A$\mu_r$ greater than 1 is is achieved at low microwave frequencies.

Figure 2:
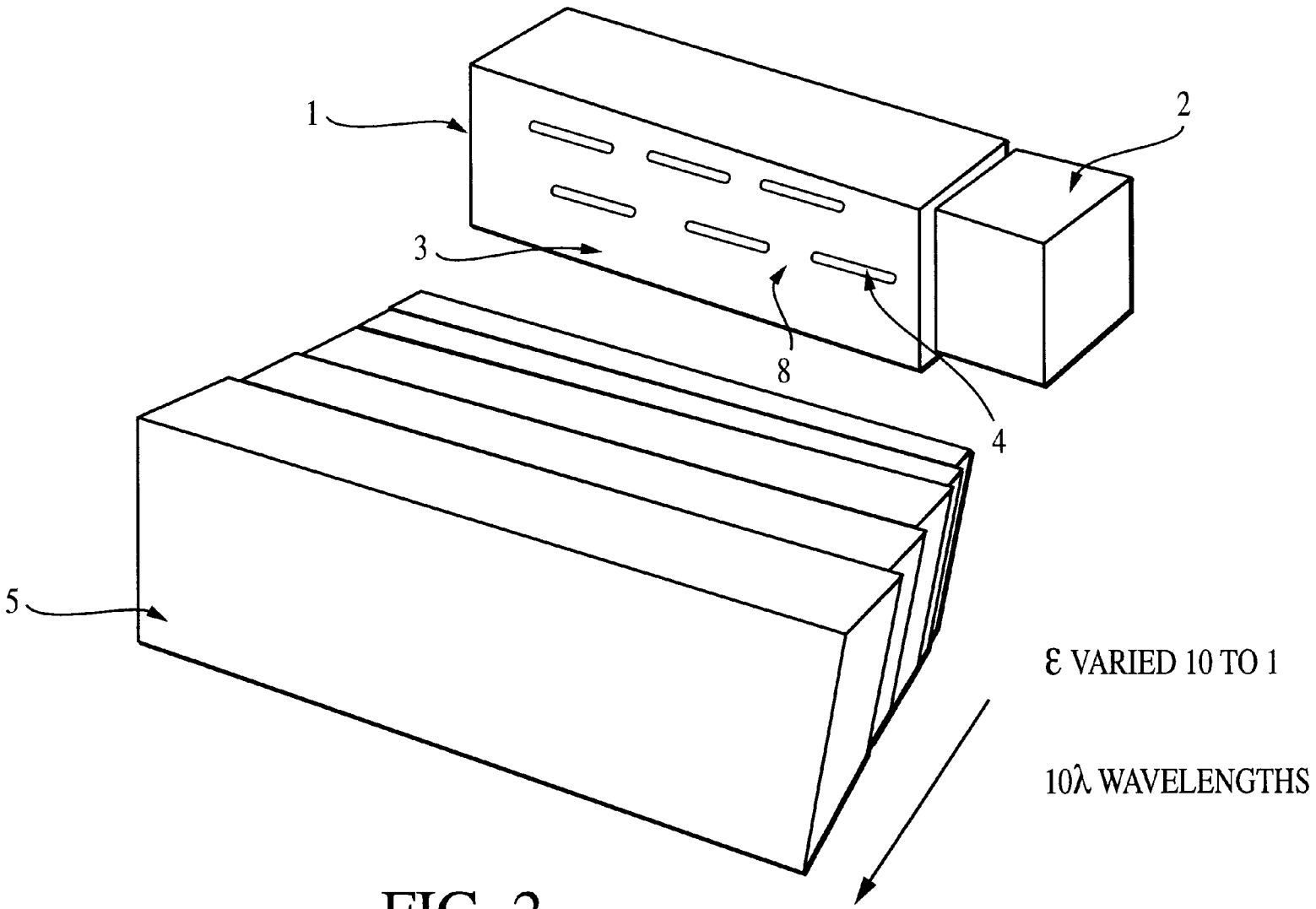
FIG. 2 is a one-element embodiment of a high-gain, dielectric loaded, slotted waveguide antenna.

The theory of slotted waveguide antennas is well founded, and the design for the waveguide element array is standard to one skilled in the art, with design equations and computer software are readily available. The primary design attributes of the antenna array are the directive gain, side lobe level, frequency bandwidth, and the physical aperture. Tradeoffs in the design attributes are made to achieve the desired performance. Therefore, the design of the antenna feed structure and antenna array elements are standard to one skilled in the art. This invention teaches how to efficiently radiate the energy from the dielectric loaded, slotted waveguide element array into free-space. An impedance mismatch is present at the slots of the waveguide due to the air/dielectric interface. This mismatch becomes larger as the dielectric constant of the material inside the waveguide becomes larger. However, the impedance mismatch can be reduced by using a material(s) that also have $\mu_r$ greater than 1. If the medium outside the waveguide elements is the same as inside the waveguide elements for a dielectric constant of 9, then the radiation pattern is equivalent to that of air as the media. Thus a dielectric slab placed in contact with the waveguide slots will efficiently couple energy through the slots into the dielectric slab. FIG. 2 shows the technique for one element. The dielectric slab is further designed to have its dielectric constant vary either discretely or continuously from a value at the inner most surface equal to the dielectric constant of the material in the waveguide element to a value equal or close to the value of free-space at the outer most surface. The depth of the slab should be at least equal to several of the average wavelengths of the slab medium, and preferably equal to 10. The cross-sectional area of the dielectric slab should be at least as large as the cross-sectional area of the 40-element array.

The design technique for discrete variation of the dielectric constant from a value of 5 to a value of 1 is to use the computer code HFSS by ANSOFT, Inc. A gaussian profile provides the best voltage standing wave ratio (VSWR) for the length of the dielectric slab. A parameter N (related to the standard deviation in gaussian statistics) is used as a modeling parameter. A value of N=4 provides the best VSWR (VSWR<1.035 from 1.1 GHz to 1.5 GHz) for a transition length of 25.6 inches (approximately two 1 GHz free space wavelengths). The lengths of each constant dielectric layer with their corresponding dielectric constants are given in table 1. The distance is the measure in inches from the air boundary, and is the center of each constant dielectric layer. There are 16 layers, and the tapering thickness of each layer is 1.6 inches.

TABLE 1

Dielectric Gradient Contours

| Distance (inches) | Relative Dielectric Constant |
|---|---|
| 0.7984 | 1.0198 |
| 2.3785 | 1.0760 |
| 3.9642 | 1.1557 |
| 5.5499 | 1.2616 |
| 7.1355 | 1.3973 |
| 8.7212 | 1.5668 |
| 10.307 | 1.7732 |
| 11.893 | 2.0180 |
| 13.478 | 2.2991 |
| 15.064 | 2.6107 |
| 16.650 | 2.9437 |
| 18.235 | 3.2887 |
| 19.821 | 3.6396 |
| 21.407 | 3.9970 |
| 22.992 | 4.3698 |
| 24.578 | 4.7761 |

Figure 6:
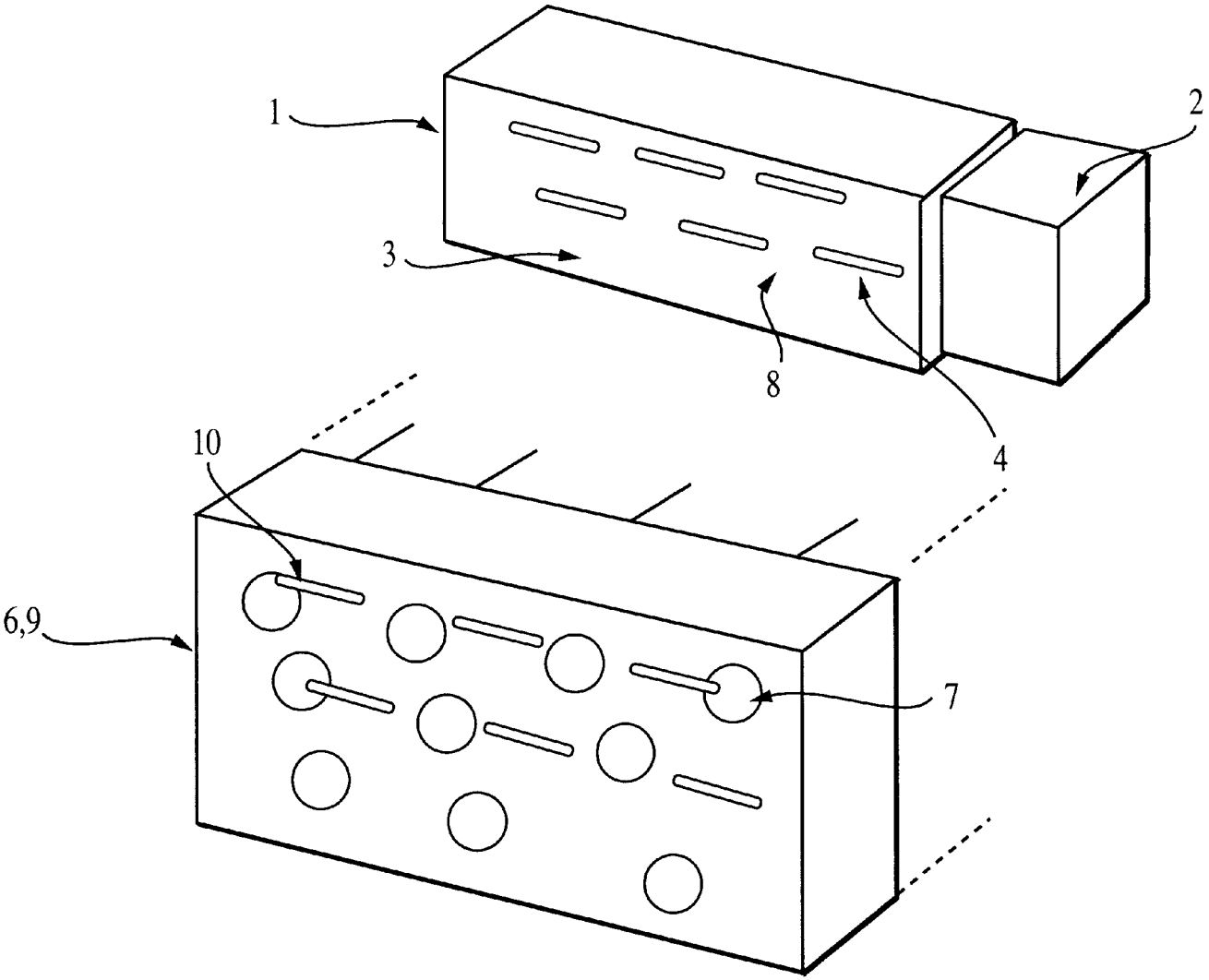
FIG. 6 is one-element of another embodiment of a high-gain, dielectric loaded, slotted waveguide antenna.

In addition to the dielectric slab, a photonic band gap (PBG) structure is used for the preferred embodiment as shown in FIG. 6. The theory and operation of PBG structures are well founded, and are designed by one skilled in the art. U.S. Pat. No. 5,739,796 and dated Apr. 14, 1998 teaches the PBG structure art. The photonic crystal is a periodic high-permittivity dielectric structure whose EM dispersion relation has a band structure similar to that of electrons in crystalline solids. Photonic crystals can be made to exhibit a forbidden range of frequencies (band gap) in their dispersion relationship. The band gap property makes the photonic crystal well suited for planar antennas. The PBG structure is designed with a band gap at the same frequency and bandwidth of the antenna and HPM tube output. Therefore, energy that falls within the band gap will be rejected (reflected) from the PBG structure. The PBG structure is designed to be either a 2- or 3-dimensional version, have an effective dielectric constant equivalent to the dielectric constant of the waveguide medium, have low loss tangent, and have high-voltage breakdown potential. Since the microwave energy is forbidden to enter the PBG structure, channel defects are made in the PBG structure that are equal in number to the waveguide slots and have geometrically equivalent cross-sectional areas to- and perfectly aligned with the slots. The channels serve as radiating paths in the PBG structure. The PBG structure eliminates propagating surface and confines the radiation to the channels. One specific type of PBG structure can be designed that will allow microwave energy to enter in one direction, but forbids it to enter in the opposite direction. This type of PBG structure would have a nonreciprical band gap. The design of this type of one-way band gap requires a design that gives a spin reversal inside the band gap. This can be achieved by using materials such as nickel. However, this requires complexity in the design.

Figure 3A:
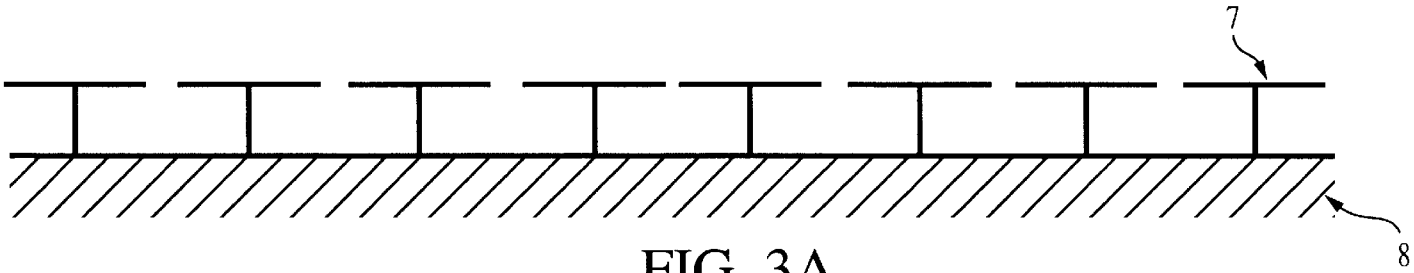
FIG. 3 is a two-layer photonic band gap (PBG) high-impedance EM structure.
Figure 3C:
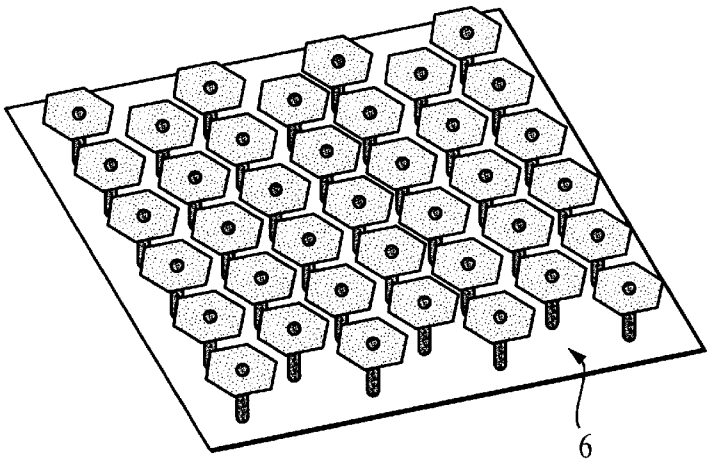
Figure 3B:
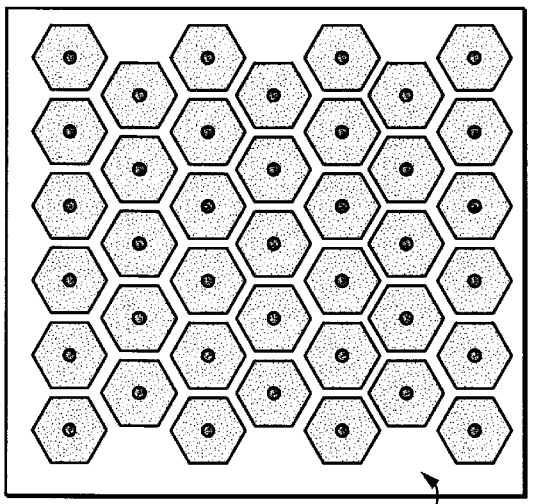
Figure 4:
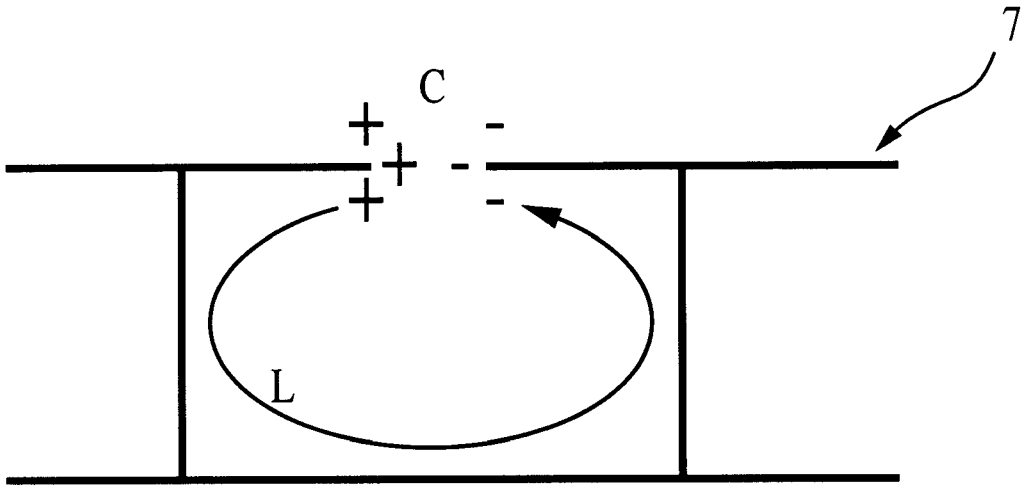
FIG. 4 is the equivalent circuit for the high-impedance EM structure.
Figure 4:
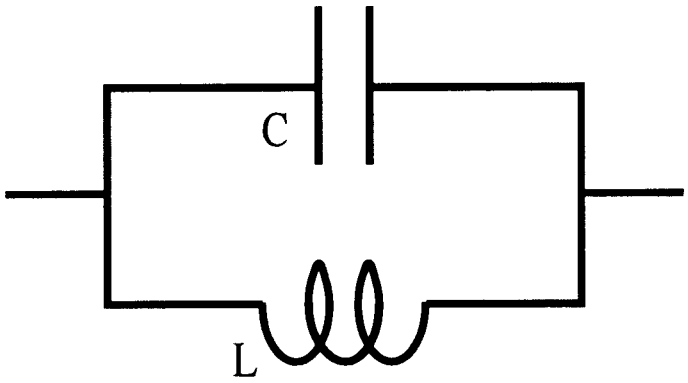
Figure 5A:
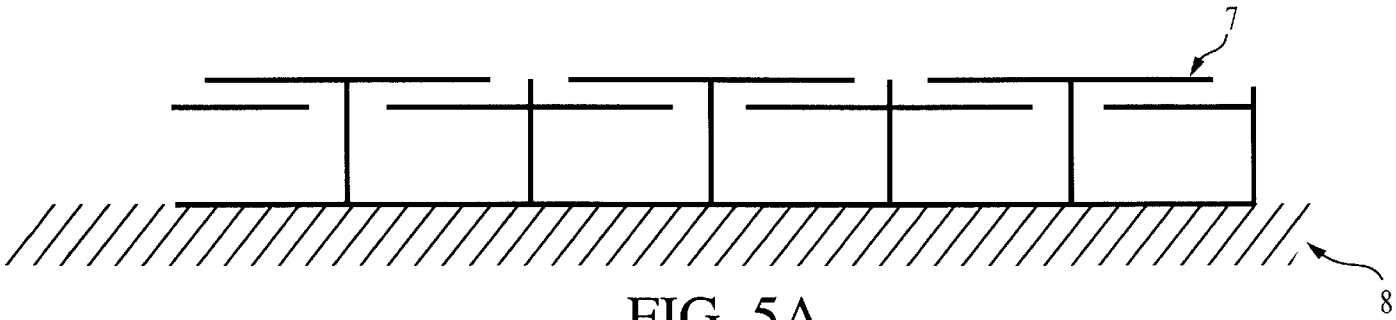
FIG. 5 is a three-layer photonic band gap (PBG) high-impedance EM structure.
Figure 5C:
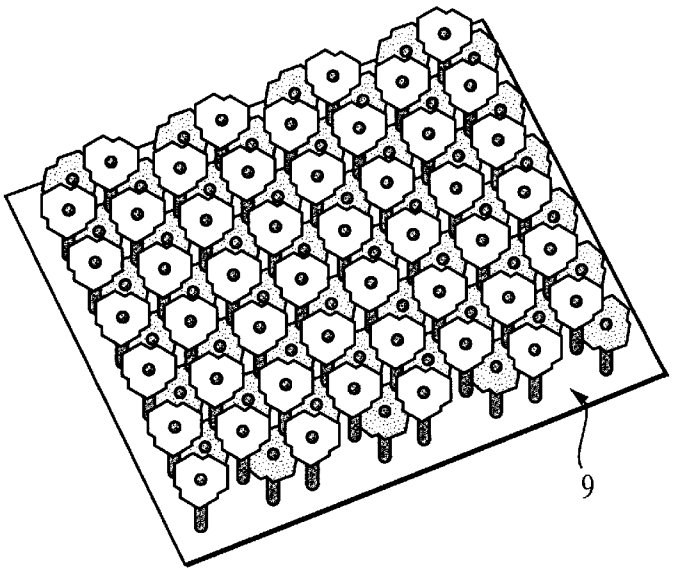
Figure 5B:
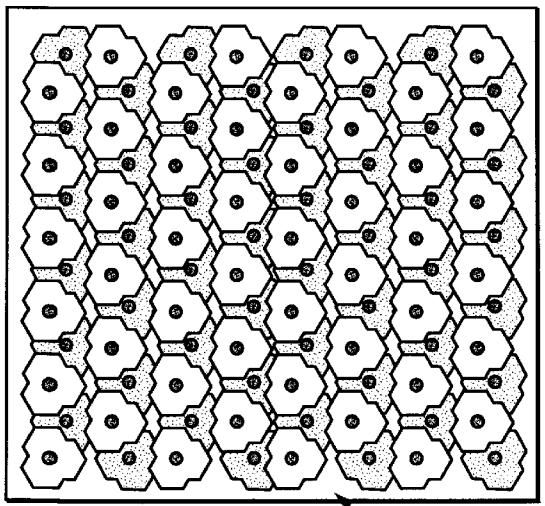

Another specific PBG structure is the high-impedance EM structure that is shown in FIGS. 3, 5, 6 and 7. The high-impedance EM, PBG structure is a conductive metallic structure which, has a high radio frequency impedance. This metallo-dielectric PBG structure suppresses surface currents and introduces in-phase image currents that allow conformal antenna designs. FIG. 3 is the 2-layer version, and FIG. 5 is the 3-layer version. They are 2-dimensional PBG structures. The structures have capacitive and inductive elements. They act like tiny parallel resonant circuits, which block surface current propagation, and also reflect EM waves with zero phase shift. FIG. 4 is the equivalent circuit for the high-impedance structure. The 3-layer version has overlapping metal "thumbtack" like structures so that the capacitance is increased between adjacent elements, and the corresponding operating frequency is lower. Voltage arcing at the metal "thumbtack" edges can be reduced by rounding the edges and using high-voltage breakdown dielectric materials. This high-impedance EM, PBG structure is used to prevent cross-talk from occurring at the outer surface of the waveguide elements. Since the antenna structure is now very compact, with the slots much closer together than the air-filled version, the elimination of surface currents is needed to achieve a good radiating beam profile.

The channels in the PBG structure may have either air or a tailored dielectric medium. A tailored dielectric medium is useful for better matching at the interfaces between the waveguide and PBG structure at the compromise of some design and fabrication complexity.

The preferred PBG structure has both the high-impedance EM, PBG structure, and the tailored dielectric structure. To reduce the overall weight of the antenna, the tailored dielectric structure can use a high-dielectric constant ($\epsilon$>50), ferroelectric material with a low loss tangent (<0.001) imbedded in a very light-weight insulating material with a dielectric constant close to 1, such as Styrofoam. By imbedding the ferroelectric particles or a mesh in the low-dielectric material, one can greatly reduce the weight of the tailored dielectric structure. In addition, one can achieve a tailored dielectric structure by tailoring the ferroelectric particle density or mesh density. Table 2 gives a sample of BSTO-oxide III ferroelectric material composites that are commercially available.

TABLE 2

| OXIDE III CONTENT | DIELECTRIC CONSTANT | LOSS TANGENT |
|---|---|---|
| 15% | 1147 | 0.0011 |
| 20% | 1079 | 0.0009 |
| 25% | 783 | 0.0007 |
| 30% | 751 | 0.0008 |
| 35% | 532 | 0.0006 |
| 40% | 416 | 0.0009 |
| 60% | 115 | 0.0006 |
| 50% | 17 | 0.0008 |

It is understood that one skilled in the art can design other specific PBG structures and tailored dielectric structures, however, the scope of this invention is limited only by the claims appended herein.

Figure 1:
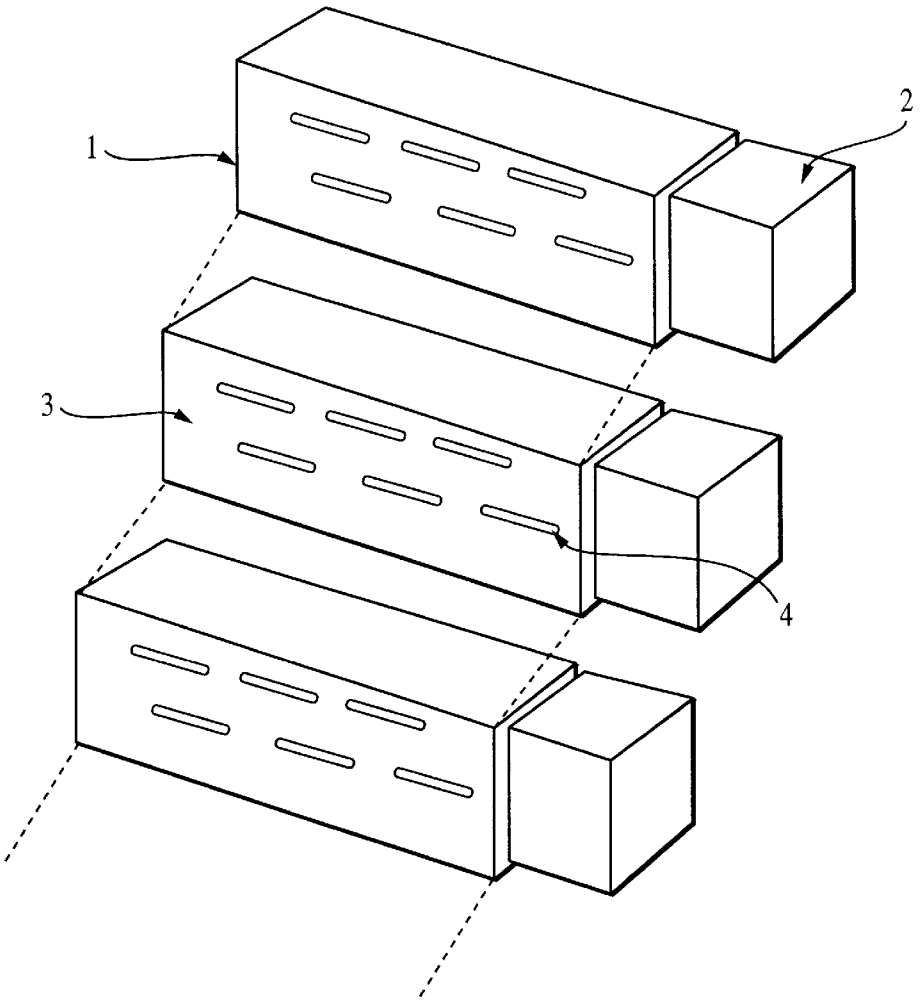
FIG. 1 is a multi-element array of dielectric loaded, slotted waveguides.

In FIG. 1 is a dielectric loaded slotted waveguide element 1 filled with a low loss tangent, high-voltage breakdown dielectric material 2 that is available commercially. Table 3 gives the properties of sample dielectric materials 2. The dielectric material is either coated with a metal conducting material 3 or inserted into a metal waveguide structure 3 that has predesigned longitudinal slots 4 cut or etched out of the conductive material 3 on its outer surface 8. Said waveguide elements are stacked into four modules with 10 waveguide elements per module. The more waveguide elements per module, and the more modules used give higher antenna gain at the compromise of a larger antenna. The corporate feed network is not shown in FIG. 1 for simplicity purpose, but each module has a microwave feed structure at the back surface of the module. Conductive end caps, also not shown, are placed on both ends of each waveguide element 1. The preferred embodiment has 10 longitudinal slots per waveguide element 1. FIG. 2 shows a tailored dielectric structure 5 that is placed in contact with the waveguide outer surface 8 containing slots 4. For simplicity, only one element is shown in FIG. 2. The dielectric structure 5 is designed to have its dielectric constant vary either discretely or continuously. Its effective dielectric constant varies from a value at the inner most surface equal to the dielectric constant of the material 2 inside of the waveguide element, to a value equal or close to the value of free-space at the outer most surface. The depth of structure 5 should be at least equal to several average wavelengths, and preferably equal to 10 average wavelengths of the slab 5 medium. The cross-sectional area of the dielectric structure 5 should be at least as large as the cross-sectional area of the 40-element array. When the dielectric structure 5 has a discrete variation in the dielectric constant such as 9, 8, 7, . . . 3, 2, 1 then impedance matching is required at all interfaces.

TABLE 3

| ECCOSTOCK HiK: | |
|---|---|
| DIELECTRIC CONSTANTS | 3 to 15 |
| APPEARANCE | WHITE |
| DISSIPATION FACTOR | <0.002 (1 to 10 GHz) |
| TEMPERATURE RANGE | −65 TO 110 (DEGREES C) |
| VOLUME RESISTIVITY | $>10^{12}$ (OHMS-CM) |
| FEXURAL STRENGTH | 6500 (PSI) |
| DIELECTRIC STRENGTH | >200 (VOLT/MIL) |
| COEFFICIENT of LINEAR EXPANSION | 36 ($10^{-6}$/° C.) |

(HIGHER TEMPERATURE AND DIELECTRIC STRENGTH MATERIALS AVAILABLE IN ECCOSTOCK HiK500F)

In another embodiment shown in FIG. 6, a photonic band gap (PBG) structure 6 or 9 is used. The PBG structure 6 shown in FIG. 3 is a 2-layered high-impedance EM structure having an equivalent circuit as shown in FIG. 4. The PBG structure 6 or 9 has metal "thumbtacks" 7 and defect channels 10 as elements of the PBG crystal lattice. The 3-layer high-impedance BPG structure 9 of FIG. 5 has overlapping metal "thumbtacks" 7 which makes it suitable for use at lower frequencies. Since the microwave energy is forbidden to enter the PBG structure, the channel defects 10 are made in the PBG structure that are equal in number to the waveguide slots and have geometrically equivalent cross-sectional areas to- and perfectly aligned with the slots. The channels 10 serve as radiating paths in the PBG structure. These channels 10 can have either air or a tailored dielectric medium. The high-impedance EM PBG structure 6 or 9 makes contact with the outer surface 8 of each waveguide element.

Figure 7:
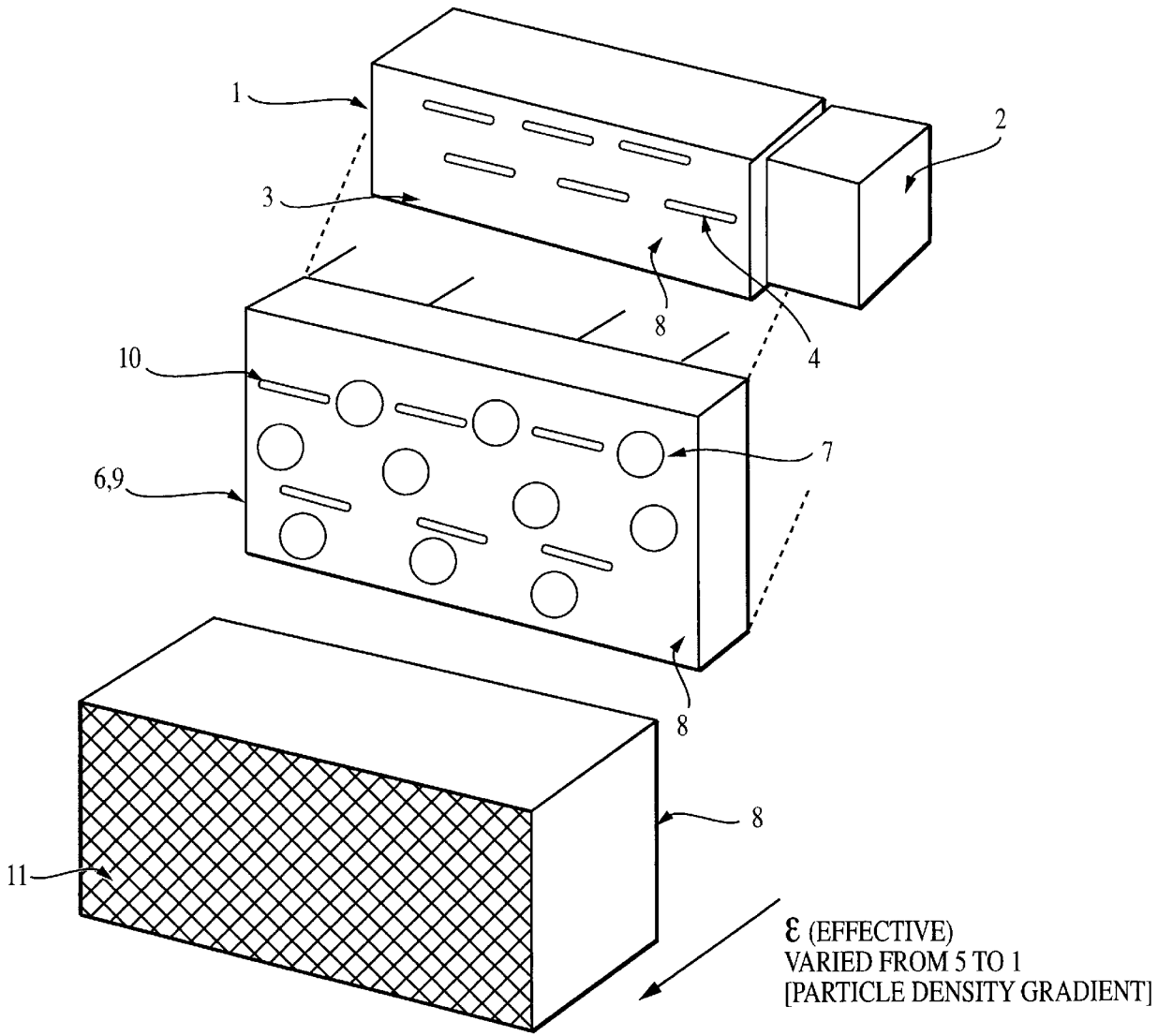
FIG. 7 is one-element of the preferred embodiment of a high-gain, dielectric loaded, slotted waveguide antenna.

In the preferred embodiment shown in FIG. 7, the photonic band gap (PBG) structure 6 or 9 is used. The PBG structure 6 or 9 is designed to be either a 2- or 3-dimensional version, have an effective dielectric constant equivalent to the dielectric constant of the waveguide medium, have low loss tangent, and have high-voltage breakdown potential. Since the microwave energy is forbidden to enter the PBG structure 6 or 9, channel defects are made in the PBG structure 6 or 9 that are equal in number to the waveguide slots and have geometrically equivalent cross-sectional areas to- and perfectly aligned with the slots. The channels serve as radiating paths in the PBG structure 6 or 9. The PBG structure 6 or 9 eliminates propagating surface waves, gives image currents that are in phase, and confines the radiation to the channels. A tailored dielectric structure 11 is placed in direct contact with the outer surface 8 of PBG structure 6 or 9. The microwave energy will efficiently be coupled through the slots of the PBG structure 6 or 9 into the tailored dielectric structure 11. The tailored dielectric structure 11 is further designed to have its effective dielectric constant vary either discretely or continuously. The value of the effective dielectric constant at the inner most surface is equal to the dielectric constant of the material in the waveguide element and the effective dielectric constant of the PBG structure 6 or 9. The value is then reduced from the value at the inner most surface to the value of free-space at the outer most surface. The depth of the tailored dielectric structure 11 should be at least equal to several of the average wavelengths of the slab medium, and preferably equal to 10. The cross-sectional area of the tailored dielectric structure 11 should be at least as large as the cross-sectional area of the 40-element array, and the cross-sectional area of the PBG structure 6 or 9. When the technique is used for embedding ferromagnetic particles or ferromagnetic mesh inside a material like Styrofoam to form the tailored dielectric structure 11, then one should enclose the PBG structure 6 or 9 and the tailored dielectric structure 11 inside a protective shield that is transparent and low-loss to microwave energy. This will protect them from the outside environment.

It will be readily seen by one of ordinary skill in the art that the present invention fulfills all of the objects set forth above. After reading the foregoing specification, one of ordinary skill will be able to effect various changes, substitutions of equivalents and various other aspects of the present invention as broadly disclosed herein. It is therefore intended that the protection granted hereon be limited only by the definition contained in the appended claims and equivalents thereof.

Having thus shown and described what is at present considered to be the preferred embodiment of the present invention, it should be noted that the same has been made by way of illustration and not limitation. Accordingly, all modifications, alterations and changes coming within the spirit and scope of the present invention are herein meant to be included.

We claim:

1. A high-gain, dielectric loaded, slotted waveguide antenna comprising:

a dielectric loaded slotted waveguide element;

said dielectric loaded slotted waveguide element filled with a low loss tangent, high-voltage breakdown dielectric material;

a composite material loaded slotted waveguide element filled with low-loss tangent, high-voltage breakdown composite material with relative permittivity and permeability greater than one;

a tailored dielectric structure placed in contact with the outer surface of said slotted waveguide element;

a tailored relative permittivity and permeability material structure placed in contact with the outer surface of said slotted waveguide element;

a photonic bandgap structure placed in contact with the outer surface of said slotted waveguide element.

2. The antenna of claim 1 further comprising:

a photonic band gap structure between said slotted waveguide elements and said tailored dielectric or composite materials structure.

3. The antenna of claim 2 wherein said tailored dielectric structure has a variable dielectric constant or said tailored composite material structure has a variable relative permittivity and a variable relative permeabiltiy.

4. The antenna of claim 3 wherein the depth of said structure is at least equal to several average wavelengths.

5. The antenna of claim 4 wherein the cross-sectional area of said structure is at least as large as the cross-sectional area of said slotted waveguide elements.

6. The antenna of claim 2 wherein said photonic band gap structure has metal elements configured as thumbtacks and defect channels in the photonic band gap crystal lattice.

7. The antenna of claim 6 wherein said thumbtack metal elements are overlapping.

8. The antenna of claim 7 wherein said defect channels are equal in number to said waveguide slots and have geometrically equivalent cross-sectional areas to and are aligned with said slots.

* * * * *